US006113344A

United States Patent [19]

Crowley

[11] Patent Number: 6,113,344

[45] Date of Patent: Sep. 5, 2000

[54] METHOD AND APPARATUS FOR SORTING STACKS

[75] Inventor: H. W. Crowley, Eliot, Me.

[73] Assignee: Roll Systems, Inc., Burlington, Mass.

[21] Appl. No.: 09/452,588

[22] Filed: Dec. 1, 1999

Related U.S. Application Data

[62] Division of application No. 08/936,399, Sep. 25, 1997, Pat. No. 6,022,186.

[51] Int. Cl.[7] ..... B65G 59/06

[52] U.S. Cl. ..... 414/801; 414/791.2; 414/796.1

[58] Field of Search ..... 271/131, 165; 414/791.2, 796.1, 797.6, 797.7, 798.1, 801

[56] References Cited

U.S. PATENT DOCUMENTS

| | | | |
|---|---|---|---|
| 3,640,426 | 2/1972 | Hammer | 221/67 |
| 3,690,476 | 9/1972 | Stacy | 414/796.1 |
| 4,396,334 | 8/1983 | Byrt | 414/796.1 X |
| 4,966,521 | 10/1990 | Frye et al. | 414/796.1 X |
| 5,556,254 | 9/1996 | Darcy et al. | 414/796.1 X |

*Primary Examiner*—Janice L. Krizek
*Attorney, Agent, or Firm*—William A. Loginov; Cesari and McKenna, LLP

[57] ABSTRACT

A method and apparatus for sorting books of sheets in which individual books are generated in succession is provided. This process entails the stacking of cut sheets that form a completed book in an offset arrangement relative to adjacent books. Each offset stacked book is removed from the other books by applying a lifting force between the lowest book in the stack and the next book in the stack while the lowest book in the stack is allowed to bend away from the next highest book in the stack. The bend forms a space, tunnel or separator entrance opportunity into which a projection or other separator structure is directed. The lowest book is lowered onto a conveyor and moved away from the stack. The process continues for each successive next-highest book in the stack. A support mechanism is provided to maintain the lowest book at a selected elevation as the projection moves inwardly. The support moves away concurrently to deposit the lowest book on the conveyor. A pair of alternating movable belts can be used for both the projection and the support on alternating sides of the stack.

9 Claims, 11 Drawing Sheets

METHOD AND APPARATUS FOR SORTING STACKS

RELATED APPLICATION

This is a divisional of U.S. patent application Ser. No. 08/936,399 filed Sept. 25, 1997 now U.S. Pat. No. 6,022,186.

FIELD OF INVENTION

This invention relates to a method and apparatus for producing successive stacks of justified sheets in book form, and more particularly to an improved process for forming and separating books of printed sheets without disrupting the justification.

BACKGROUND OF THE INVENTION

In conventional printing processes, printing presses that utilize offset plates, or other ink-transfer mechanisms, print a large block of book pages on a single sheet or "signature." FIG. 1 details a conventional printing process in which a pair of printing presses 20 and 22 are operated in tandem. Each press produces multi-page signatures 24 and 26 that, in this example, each include eight individual pages 28. The multi-page signatures are directed to respective stacks 30 and 32. Each signature 24 and 26 represents a discrete set of pages in a book. Typically, the stacks 30 and 32 are composed of a series of alike signatures since there is substantial set-up time and effort associated with changing the presses to prepare a new set of signatures. In other words, all signatures of a single group of pages are printed before the process moves on to the next set of signatures. Usually, a multiplicity of stacks of signatures must be prepared to create a finished book. For example, in an eighty-page book, ten separate stacks of signatures must be prepared. Each stack includes a total number of signatures that equals the number of books to be completed. Note that each signature can be reprinted on an opposing side so that the resulting pages include double-sided print.

After the printing step, the signature stacks 30 and 32 are directed to a cutter 34 in a selected order to produce a resulting stack 36 of bindable facing pages. The facing pages each consists of two individual page halves 28 that are folded along a center line 38 to generate the actual pages of a book. The stack 36 is ordered so that the facing pages can be folded and bound in to completed books 40 in a binding step. As described below, this stacking step is typically completed only after all signatures necessary to complete the book have been printed, cut and sorted. Appropriate binding equipment (not shown) is used to create completed, bound books. Covers and other decoration can be applied in later steps to the finished bound books in the stack 40.

A disadvantage of conventional printing processes is that groups of signatures must be collected, sorted and ordered before the cutting and binding steps can proceed. Unless a large number of printing presses are run in tandem to produce all the signatures necessary for the completion of a book at one time, several print runs through the same printing presses are required to create all the necessary signatures. Hence, stacks of signatures are typically stored awaiting completion of the printing run, and only then are the signature stacks fed in an appropriate order to cutters and binders. Often, the printing, storage, cutting and binding operations take place in different parts of the floor space of a printing house or even in different buildings. The multiplicity of dashed-lines 50 represent different points in a conventional printing process where substantial delays for storage and transport of print media awaiting completion typically occur. This conventional approach to book printing, thus, involves significant costs due to inherent delays in the process. In addition, the conventional printing approach entails additional costs for transport of materials around the production floor and for additional storage space.

The versatility of modem image transfer devices, such as high-volume laser printers, has become widely recognized in the printing field. Computer-driven, electronic print engines, such as laser printers, enable the user to instantaneously change the nature and quantity of the printing at any time during a production run. Electronic printing devices are versatile—able to print on single sheets, single-width webs, or double-width webs that are slit and merged at a later time. These printers can be arranged to print in duplex mode so that both sides of a sheet or web are provided with printing. A variety of cutters can be provided to reduce the size of sheets and/or webs to generate output that is similar to the stack 36 of double-faced sheets of FIG. 1.

However, forming a multiplicity of completed stacks of pages in book form directly from the printer poses certain problems. To enable transport, and to save space, books may be stacked. It is desirable that each book in the stack be justified along its edges to enable rapid binding. However, the separation of a large stack of completed books is problematic. Most conventional stack-separation techniques cannot ensure that the separated books will retain the desired justification. This may slow the otherwise quick and versatile electronic printing process in which complete books are produced in succession.

Given the versatility of computer driven print engines, it is an object of this invention to provide a print-on-demand process in which an entire book of sheets is generated in a single print run and such books are stacked in succession, free of the intermediate storage steps of conventional printing. It is the further object of this invention to provide an efficient technique for dividing stacks of finished sheets into individual books without misalignment of pages or undesirable adhesion of the pages of different books to each other.

SUMMARY OF THE INVENTION

A method and apparatus for sorting books of sheets to facilitate an electronic print-on-demand process in which individual books are generated in succession is provided. This process entails the stacking of cut sheets that form a completed book in an offset arrangement relative to agreement books. Each offset-stacked book is removed from the other books by applying a lifting force between the lowest book in the stack and the next book in the stack while the lowest book in the stack is allowed to bend away from the next highest book in the stack. The bend forms a "tunnel" or "separator entrance opportunity" into which a projection or other separation structure is directed. The lowest book is, thus, lowered onto a conveyor and moved away from the stack. A support structure is concurrently withdrawn from the lowest book as the next book is supported by the projection. The process continues for each successive next highest book in the stack.

In one embodiment, each of a pair of projections can be provided on opposite sides of the offset stack. The lifting force can be applied to books on both sides of the stack by corresponding retractable side supports and center lifting supports that selectively engage alternating offset edges of the next-to-lowest books in the stack to form a tunnel relative to the lowest book in the stack. The projections enter as alternating sets of side supports and lifting supports create a respective tunnel between the lowest book and the next book. The projections can comprise belts having a fixed end and a moving end. The moving end is attached to a take-up roller and a support roller or other support pays out the belt onto the bottom of each next book in succession. Each projection can have two oppositely facing belts that respectively engage the top of the lowest book and the bottom of the next book during the separation process.

The lowest book is supported by a supporting structure that can comprise a series of segments that move downwardly, in succession, as the belts move into the space formed between the lowest book and the next book. The segments can be a series of driven rollers moved upwardly and downwardly by linear actuators or other lifting mechanisms. The rollers drive the separated books onto an adjacent conveyor at selected times. Alternatively, each projection can comprise a support assembly for the lowest book. The projections can move upwardly and downwardly to match the elevation of the lowest book and the next book alternately. As the next book and lowest book are separated by one projection, the other projection retracts to enable the lowest book to be separated. The projection supporting the next book now becomes the projection supporting the new lowest book (formerly the next book), and it moves downwardly, while the other (retracted) projection moves upwardly to move between the new lowest book and the new next book. Each separated book is typically transported by a conveyor for further processing.

BRIEF DESCRIPTION OF THE DRAWINGS

The foregoing and other objects and advantages of the invention will become clear with reference to the following detailed description as illustrated by the drawings, in which.

DETAILED DESCRIPTION OF AN ILLUSTRATIVE EMBODIMENT

Figure 1:
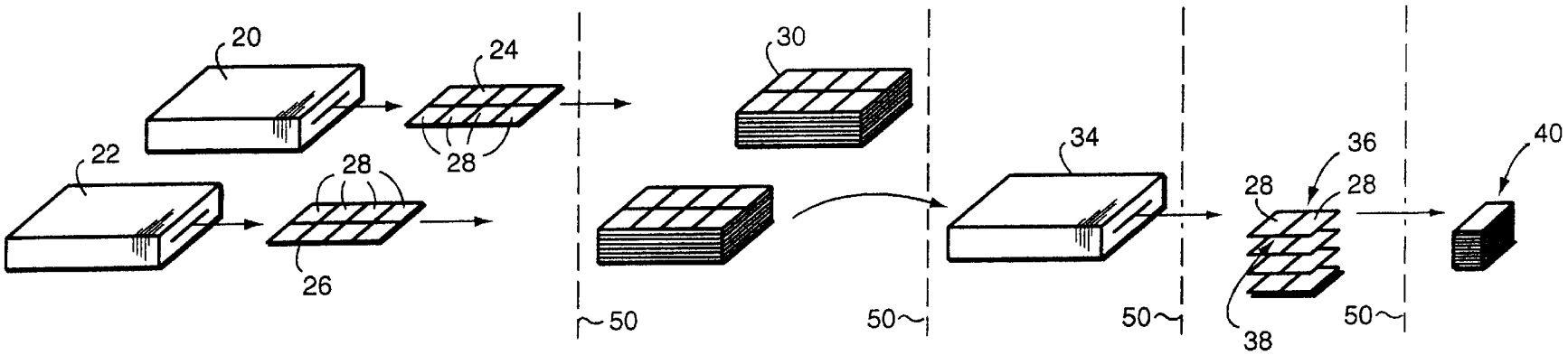
FIG. 1 (PRIOR ART)
FIG. 1 is a schematic perspective view of a conventional printing process according to the prior art.
Figure 2:
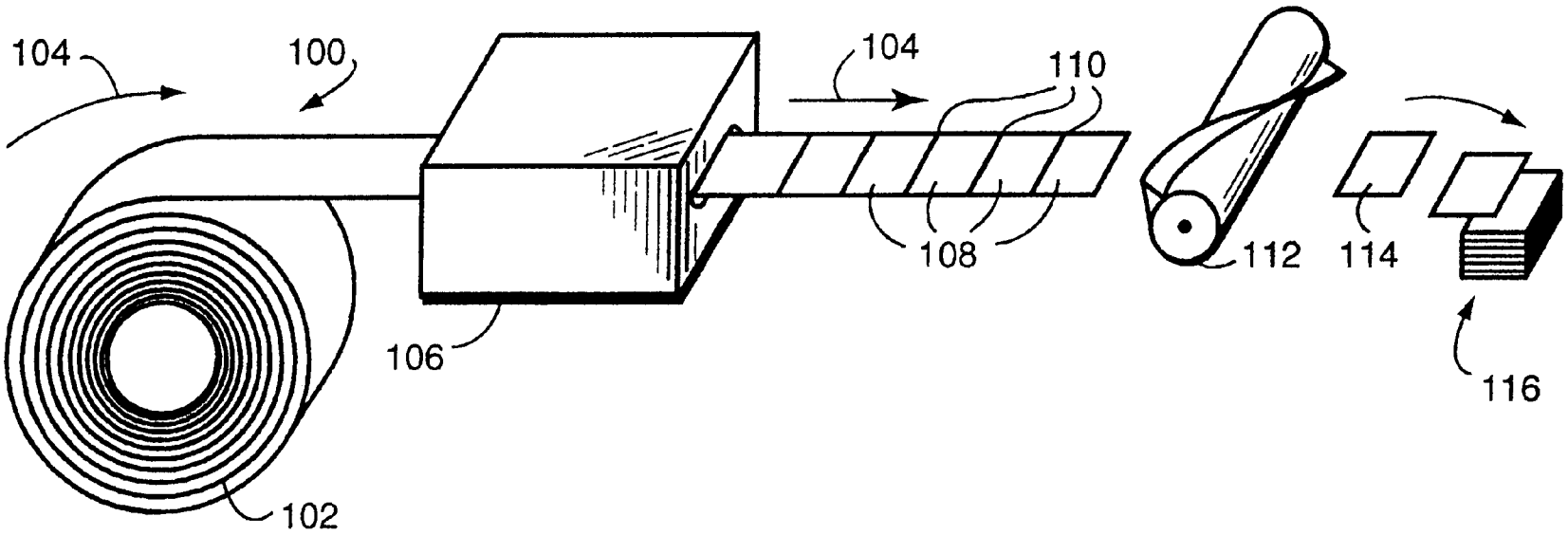
FIG. 2 is a schematic perspective view of the printing of book sheets from a continuous web according to this invention.

FIG. 2 illustrates an initial step in preparing sheets for sorting and binding according to this invention. A continuous web 100, typically stored in the form of a roll 102, is fed in a downstream direction (arrows 104) to an image transfer device 106. The image transfer device can be a laser printer, copier, printing press or other high-volume printing unit capable of printing successive programmed images on a continuous web. For the purposes of this description any form of image transfer device shall be termed a "printer." The web exits the printer 106 as a series of printed sections 108. The sections are separated by section breaks 110 shown as a series of transverse lines. The lines can be imaginary and sections can be defined as page lengths. In this embodiment the web is separated along the breaks 110 into sheets that correspond to the sections by a cutter 112 that slices each of the sheets along the breaks 110. The cutter 112 can be any acceptable cutter, such as the rotary cutter shown herein. Sheets 114 produced by the cutter 112 are formed into a single stack 116 at the output end of the cutter. Any acceptable conveyor system can be provided between the printer 106 and the cutter 112 and also between the cutter 112 and the location of the output stack 116. Such conveyors are not shown for purposes of clarity.

In a preferred embodiment, the printer 106 is a variable electronic printer that provides a different image to each section 108. Hence, the resulting sheets 114 become different pages in a report, book or other multi-page document. It is generally contemplated that the images are produced in the order in which they occur in the final bound document. The stack 116 can be a completed set of pages in such a book or bound document. While not shown, it is expressly contemplated that the web 100 is printed in a "duplex" mode in which both faces of the web 100 receive images corresponding to specific aligned sections or pages. Various techniques can be employed to accomplish accurate duplex printing such as directing the web between two printers connected in series. Each printer prints as different side of the web. Web inspection systems or tracking systems that read web travel maintain registration between the printers so that sections on both sides of the web are properly aligned.

For the purposes of this description it should be assumed that the printer 106 includes a duplex printing capability implemented, for example using two image drums, each located adjacent opposite faces of the web 100.

Figure 3:
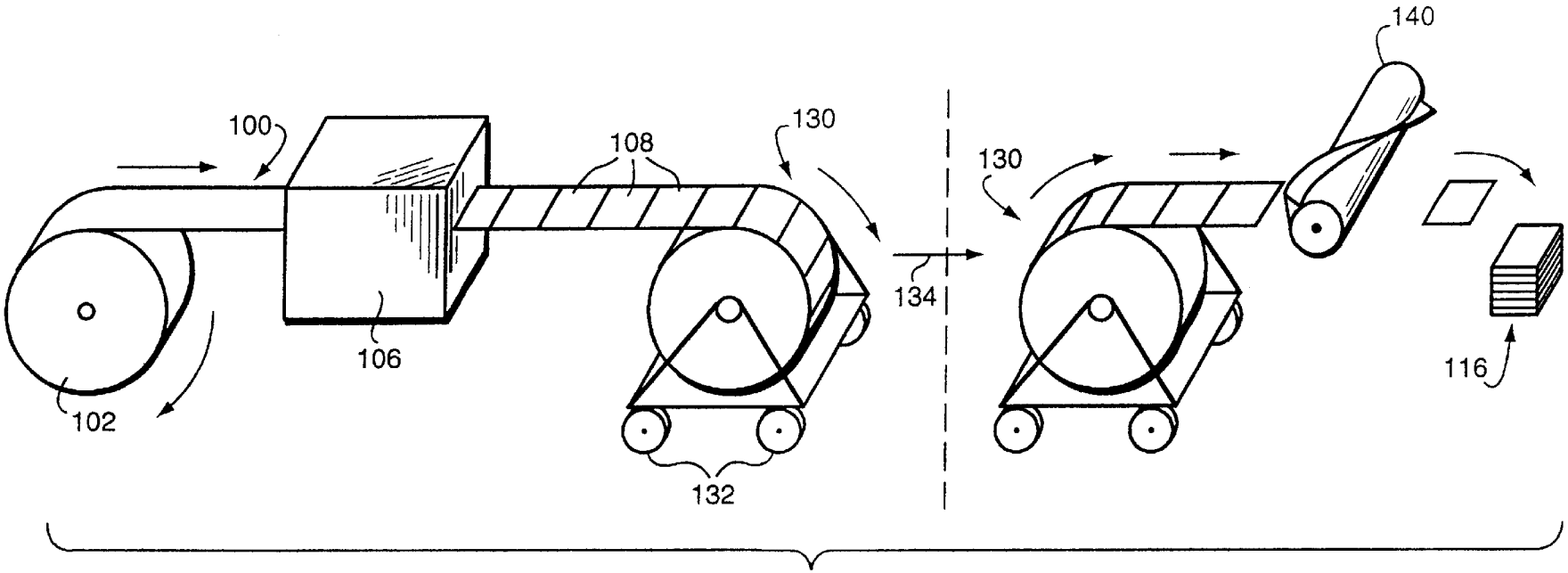
FIG. 3 is a schematic perspective view of an alternate embodiment of the printing and stacking of book sheets according to this invention.

As noted above, any acceptable conveyor system can be employed to transfer stacks between the components of the printing arrangement shown and described in FIG. 2. For example, FIG. 3 illustrates an embodiment in which the printer 106 outputs the printed web onto a rewind roller 130. The take-up roller can be any acceptable driven-roller system such as that shown and described in U.S. Pat. Ser. No. 4,893,763 and its continuations. The rewind roller 130 includes wheels 132 so that completed rolls can be moved about the work space. As shown in FIG. 3 the rewind roller 130 is subsequently moved (arrow 134) to the cutter 140 which is remote from the printer 106. As noted above, the roll 130 can first be fed through a second printer to print the opposite face, or to a different web handling device to provide enhancement to the web, such as color plates, etc. According to this embodiment, completed stack 116 is formed at a location remote from the original printer 106. Since web sections 118 are still cut in a predetermined order, the finished stack 116 is still organized with the desired page order. In this embodiment, it may be necessary, to reverse the order of page printing by the printer 106 since the stack is formed in the opposite order from that originally output by the printer 106. It can be assumed that the separation procedures to be described below are applicable to sheets transferred directly from the printer or from a rewound roll employed between the printer and the separation mechanism.

Figure 4:
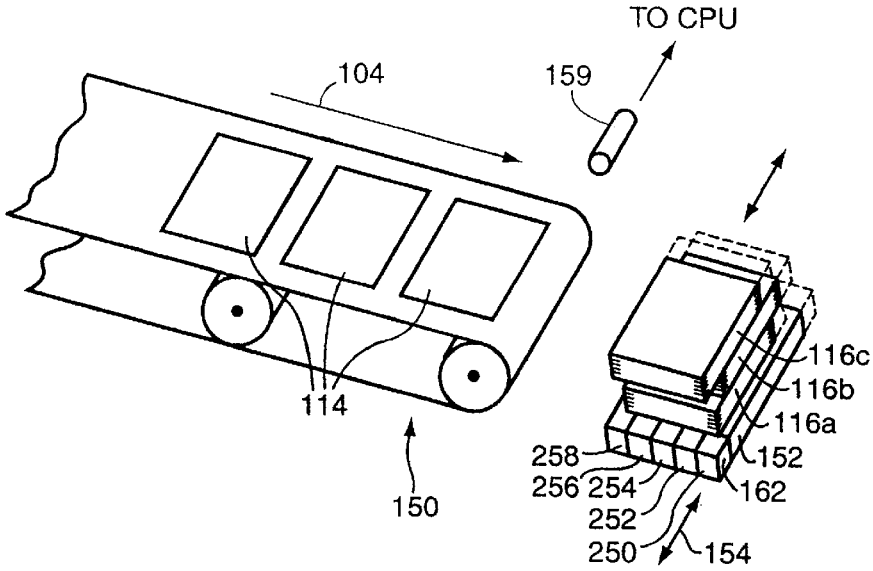
FIG. 4 is a schematic perspective view of the stacking of offset books of sheets.
Figure 5:
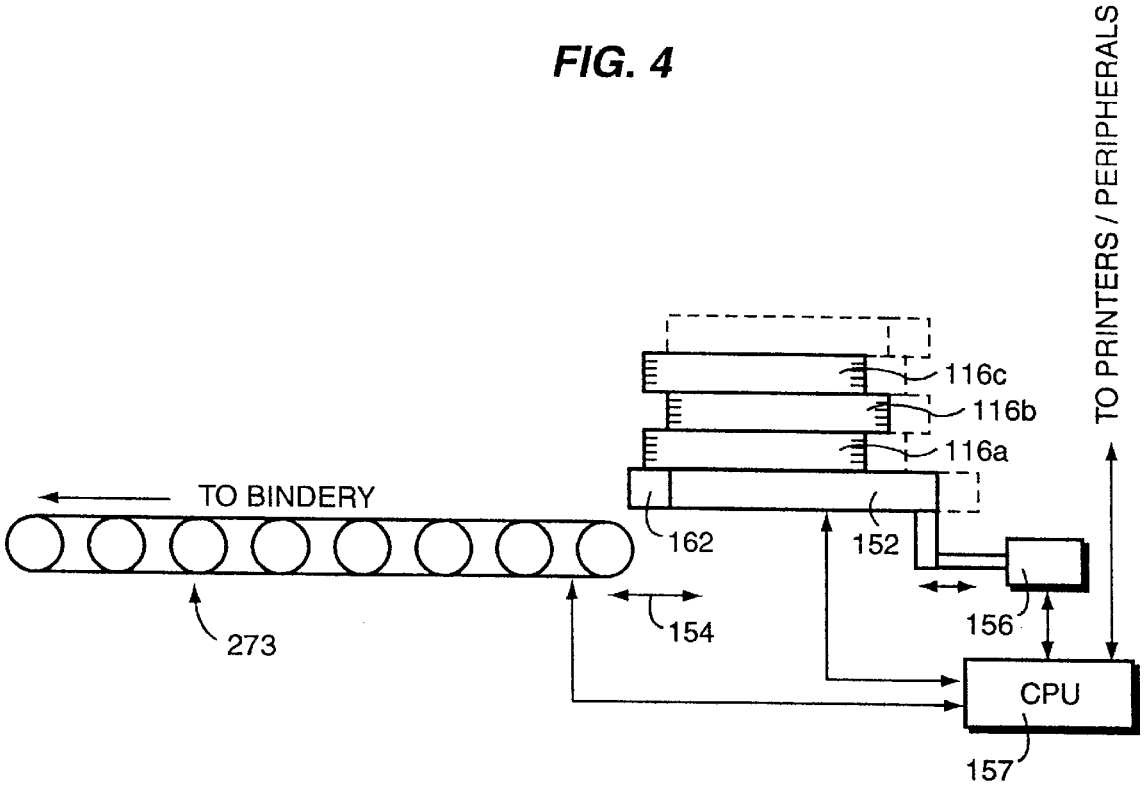
FIG. 5 is a schematic front view of the offset stacking process of FIG. 4.

The handling of output stacks is further detailed in FIGS. 4 and 5. The conveyor 150 deposits the cut sheets onto a support platform 152. The support platform 152 is moved transversely (double arrow 154) in the downstream direction (arrow 104) upon completion of each book of sheets 116*a*, 116*b* and 116*c*. In other words, the platform 152 generates a jog-offset between successive books in the stack. The offset edge can be approximately one inch. It should be sufficient to allow engagement of the edge by a set of supports to be described below, but not so large as to cause the edge to droop so much that the edge becomes misaligned. A linear actuator 156 is used to move the platform 152 in a reciprocating, side-to-side motion. The actuator 156 (FIG. 5) can be any acceptable linear actuator, interconnected with a controller or central processing unit (CPU) 157 that changes the location of the platform 152 in response to the completion of each stack. As described more fully below the CPU is also connected to, and controls operation of the downstream conveyor 273 and the moving segments support structure 152. It receives tracking information from the printer(s), upstream conveyor 150 and other associated peripherals that provide the CPU with information about the number of and location of books being delivered to the support platform 152. As books are received, the platform is instructed by the CPU to move side-to-side to produce an offset between books in the resulting stack. The separation operation, as described below, also occurs under control of the CPU. A number of well-known protocols can be employed to determine when a stack is completed. For example, the offset controller can be signaled each time the printer prints the last section in a print run and can instruct movement of the support 152 at the time in which the last sheet is expected to reach the stack following the printing of the last sheet. Alternatively, a sheet sensor 159 (FIG. 4) can signal the CPU each time a printed sheet passes into the stack. When the number of sheets passed by corresponds to the number of sheets in a given book (based upon a signal from the printer) the actuator 156 is directed to move to begin stacking the next offset book.

Each of the books 116*a*, 116*b* and 116*c* of justified sheets represents a completed book to be bound in a subsequent step. The justification of the sheets as they enter the stacks can be accomplished using a variety of techniques. For example side and rear edge guides can be provided at the stacking location and along the side edge of the conveyor. Acceptable conveyors and justifiers are taught in U.S. Pat. Nos. 5,280,903 and 5,390,909, incorporated herein by reference.

Once sheets are stacked in justified book form, one-atop-the-other in a jog-offset arrangement, it is desirable that the sheets of each book remain justified with each other. In other words, the edges of the sheets should all remain in alignment. This enables ready binding of an edge of the book. However, removal of books without upsetting the justification of the sheets requires special handling techniques.

Figure 6:
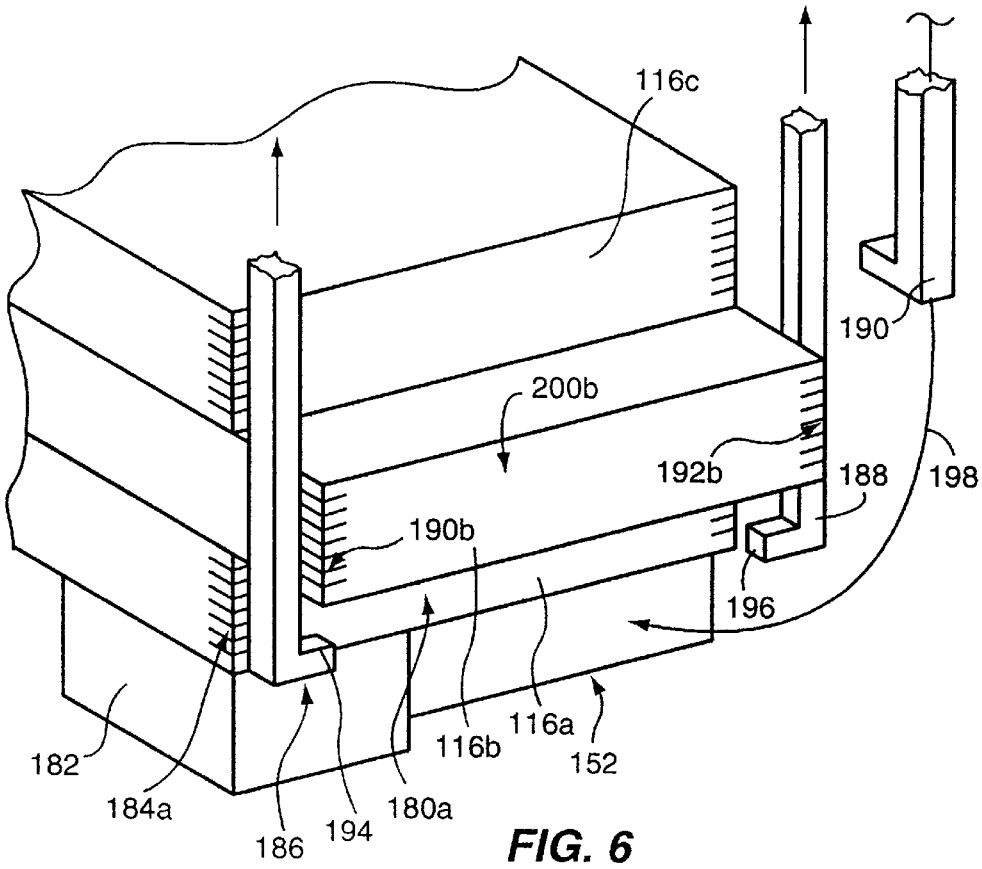
FIG. 6 is a schematic perspective view of a book stack separation process according to an embodiment of this invention detailing the movement of separator support members into position.
Figure 7:
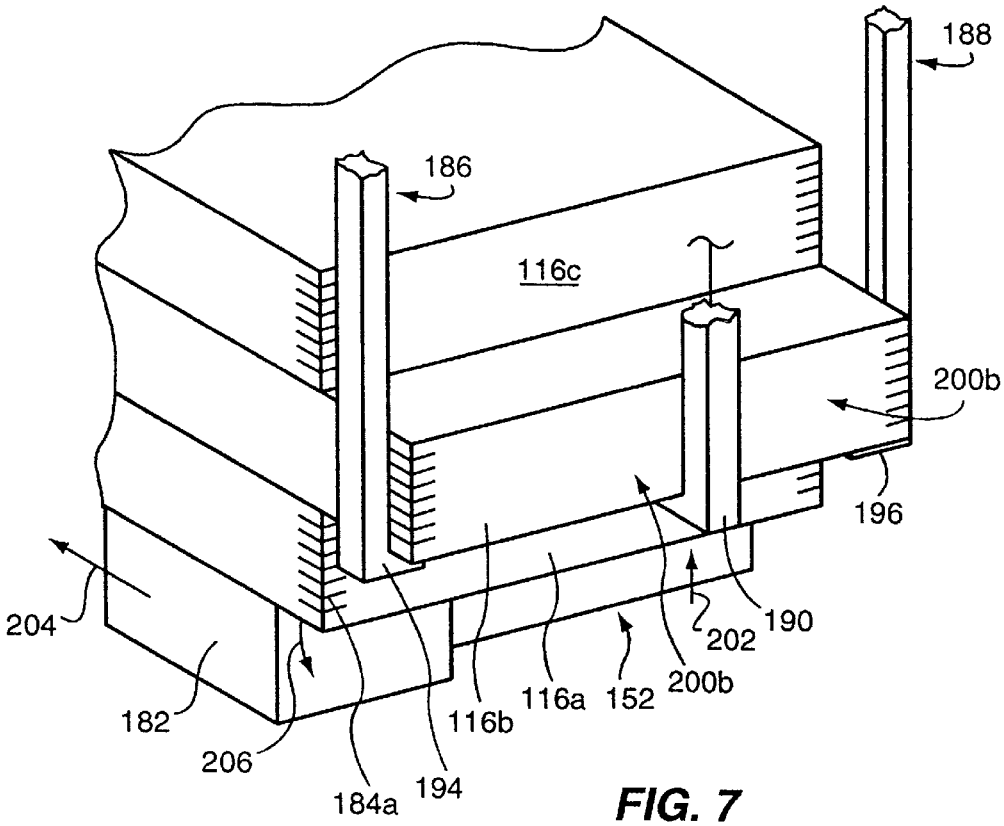
FIG. 7 is a schematic perspective view of the movement of the separator support members of FIG. 6 to enable separation of the lowest book from the remaining stack.
Figure 8:
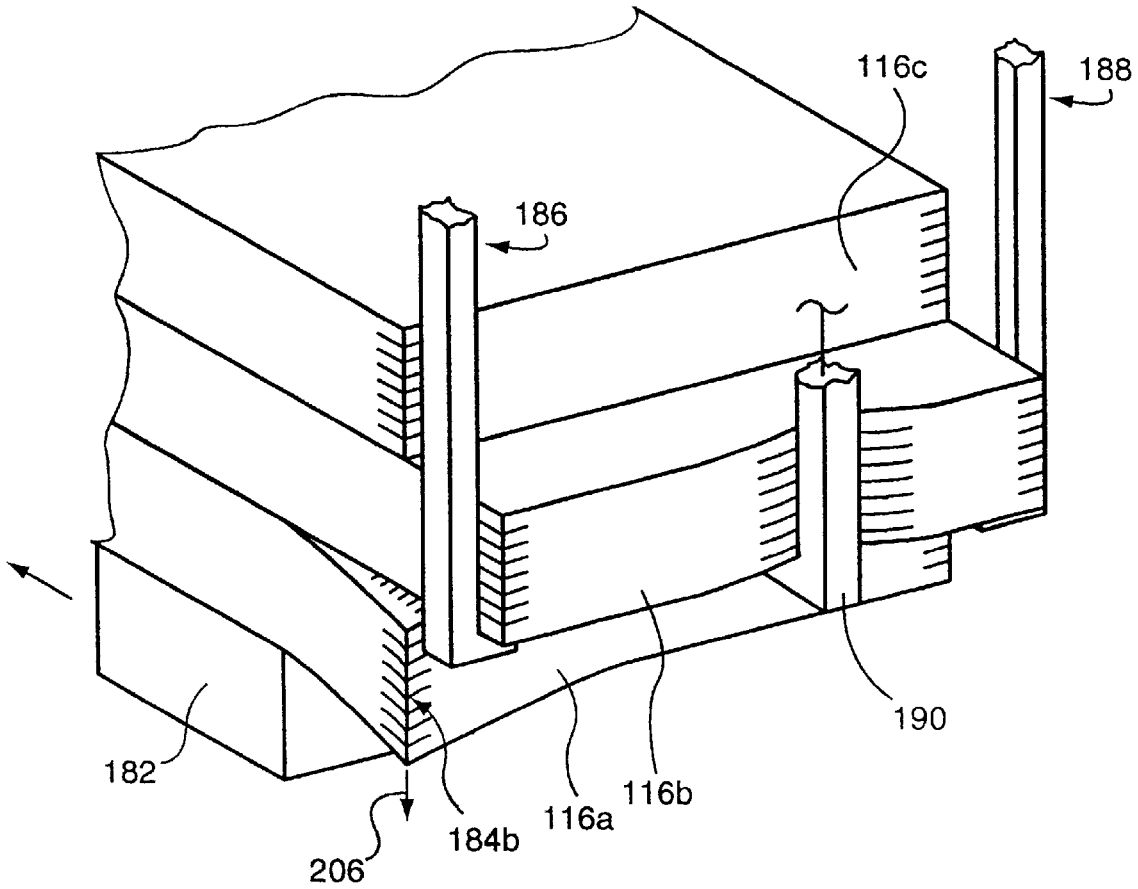
FIG. 8 is a schematic perspective view of the book separation process showing the formation of a gap between the lowest book and the stack.

FIGS. 6–8 schematically detail a unique technique for removing individual books of sheet from a jog-offset stack without disturbing the justification of the sheets within each book. The bottom stack 116*a* is supported across the majority of its surface. Near its forward edge 180*a* there is provided a moveable supporting surface 182. The moveable supporting surface 182 is located adjacent the corner 184*a* of the lowest book 116*a*.

A pair of retractable side supports 186 and 188 are provided near the forward face 180*a* of the lowest book 116*a*. A retractable forward lifting support 190 is also provided. In the first retraction step, as detailed in FIG. 6, the supporting member 182 is located adjacent the book corner 184. The mounting arrangement for the side supports 186 and 188 and lifting support 190 is not shown. It is assumed that conventional hinges, pivots and/or linear actuators mounted to a support frame can be employed to enable movement of the supports 186, 188, 190 into and out of engagement with the offset edge of the book.

The side supports 186 and 188 are positioned adjacent the corners 190*b* and 192*b* of the center book 116*b*. The base members 194 and 196 of the side supports 186 and 188, respectively, project inwardly toward each other so that they overlap the bottom surface of the center book 116*b*. The lifting support 190 is shown moving into position (arrow 198) along the front edge 200*b* of the center book 116*b*. The exact shape and movable mounting arrangement for the supports 186, 188 and 190 can be varied, depending upon the arrangement of the overall printing apparatus. It is desired that the supports be selectively movable into and out of the locations on the bottom of the book 116*b* as shown.

Once all supports are positioned, as shown in FIG. 7, the side supports 186 and 188 are moved so that the supporting surfaces 194 and 196 engage the bottom of the center book 116*b*. These supports maintain the forward edge 200*b* of the center book 116*b* suspended at a constant elevation regardless of downward movement of the lower book 116*a*. The forward lifting support 190 simultaneously engages the lower face of the center book 116*b* at an approximate mid-point along the front face 200*b*. The lifting support 190 moves upwardly (arrow 202) while the side supports 186 and 188 hold position. The supporting surface 182 retracts inwardly (arrow 204) relative to the stack, causing the corner 184*a* of the lower book 116*a* to become unsupported. Inherent book weight, bearing upon the corner 184*a*, causes the corner to droop (arrow 206). Either a corner, or the entire front edge of the lower book 116*a* can be made to droop depending upon the geometry of the supporting surface 182.

As further detailed in FIG. 8 the corner 184*a* separates from the center book's bottom surface. Similarly, the upward movement of the lifting support 190 causes slight lateral movement in the lower surface of the center book 116*b* that breaks remaining frictional, static and fiber-lock adhesion between the upper surface of the lower book 116*a* and the lower surface of the center book 116*b*. This relationship is more clearly shown in front view in FIG. 9. The lifting support 190 creates a gap 210 along the bottom surface of the center book 116*b*. The gap 210 causes lateral movement (arrows 212 and 214) of the bottom surface relative to the upper surface of the lower book 116*a*. This movement, along with the droop of the corner 184*a* of the lower book 116*a*, therefore, produces a relatively clean break in the adhesion between books. In one embodiment an upward movement of ⅛ to ¼ inch. by the lifting support 190 can generate a sufficient break between books. Similarly, a rearward movement of 1–3 inches by the supporting surface 182 can cause a sufficient droop in the corner 184*a*. Greater or smaller movements are contemplated and the movements can be varied depending on the thickness of the individual books in the jog-offset stack. Likewise, individual sheet thickness, strength and quality may necessitate a change in the movement distance of the lifting support 190 and support member 182. Optimum movement values can be determined by trial and error. In particular, values that are appropriate for a particular book size and sheet quality can be determined by incrementally changing the distance that each of the two supports move and observing the resulting separation between books. When an optimum separation has been attained, the values can be recorded and used again at a later time.

Figure 9:
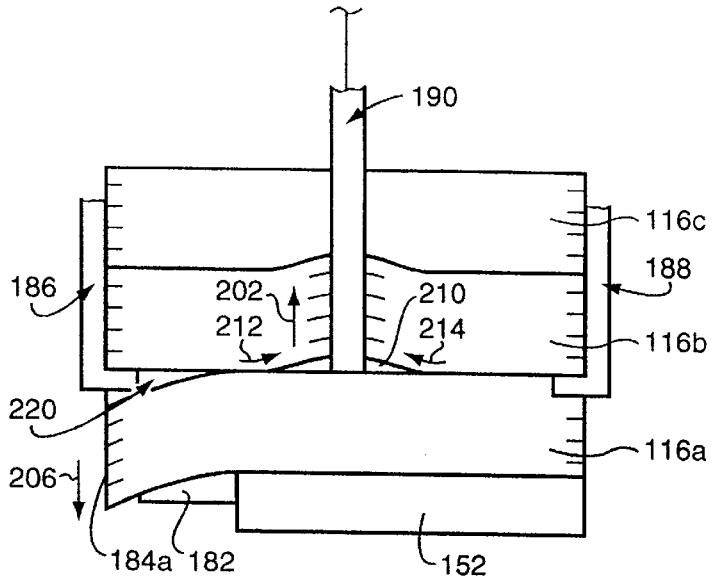
FIG. 9 is a schematic front view of the gap formation process of FIG. 8.
Figure 10:
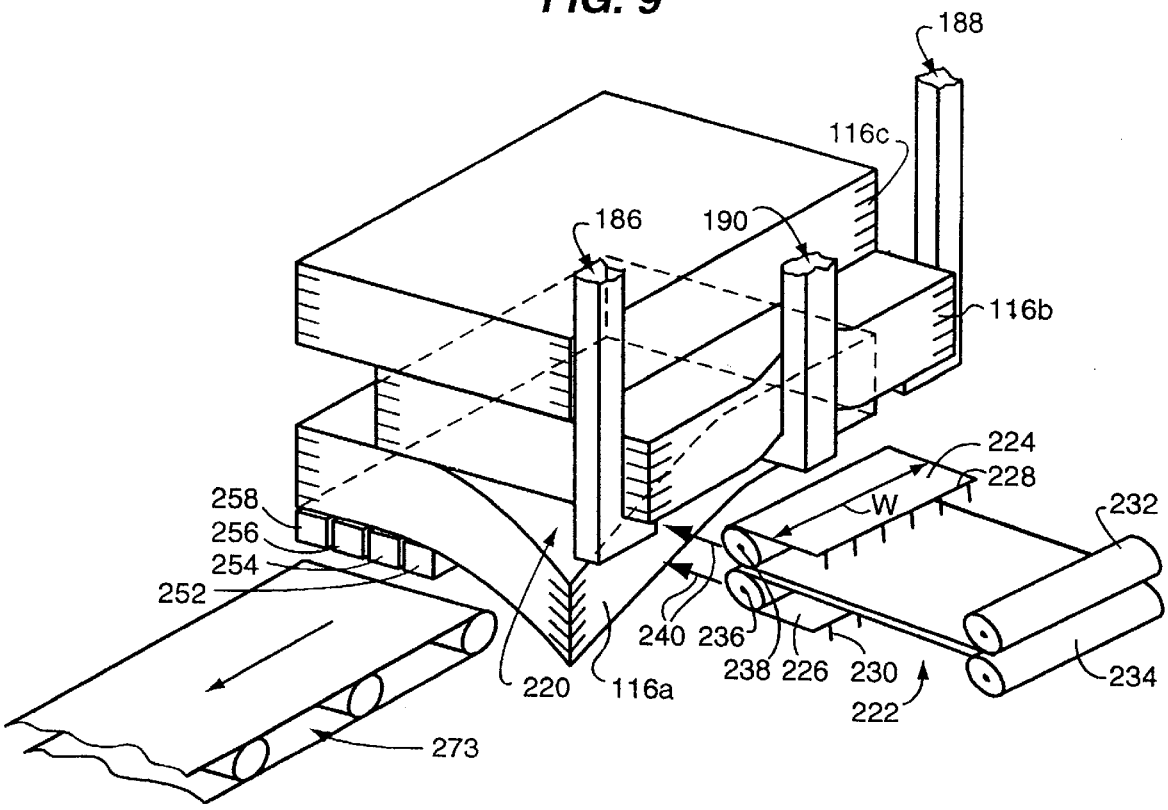
FIG. 10 is a schematic perspective view of the introduction of a separating mechanism into the gap formed between books.

Referring to both FIGS. 9 and 10, a space that defines a separator entrance opportunity or "tunnel" 220 is formed between the books 116*a* and 116*b*. This tunnel enables the insertion of a separation assembly 222. In this embodiment, the separation assembly comprises a pair of upper and lower belts that are each attached on a respective fixed end 228 and 230 to a fixed surface (not shown) such as the housing of a machine or transport mechanism. The opposing respective ends of the belts 224 and 226 are attached to take-up rollers 232 and 234. The take-up rollers 232 and 234 pay out their belts in response to forward and rearward movement of a pair of respective support rollers 236 and 238. The support rollers can also act as take-up rollers in an alternate embodiment. As shown in FIG. 10, the support rollers move forwardly (arrow 240) toward the tunnel 220. The width W of the belts 224 and 226 is sized to optimize insertion of the separation assembly 222 into the tunnel 220. Since the tunnel is generally small in width and height, the relative diameters of the rollers 236 and 238 that support the belts 224 and 226 can be correspondingly small-sized to facilitate insertion. Various types of separation members other than the moving belts can be employed can be utilized. For example, a flat plate can be driven between books. The illustrated dual-oppositely facing belts 224 and 226 used as a separation assembly 222 in this embodiment are advantageous because the belts 224 and 226 do not slide relative to the facing surfaces of each of the books 116*a* and 116*b*. Rather, each belt is paid out onto each book's surface by a respective roller 236 and 238 by substantially direct application to the confronting book surface, and without inducing sliding motion. This minimizes the possibility of sheet misalignment in each book.

Figure 11:
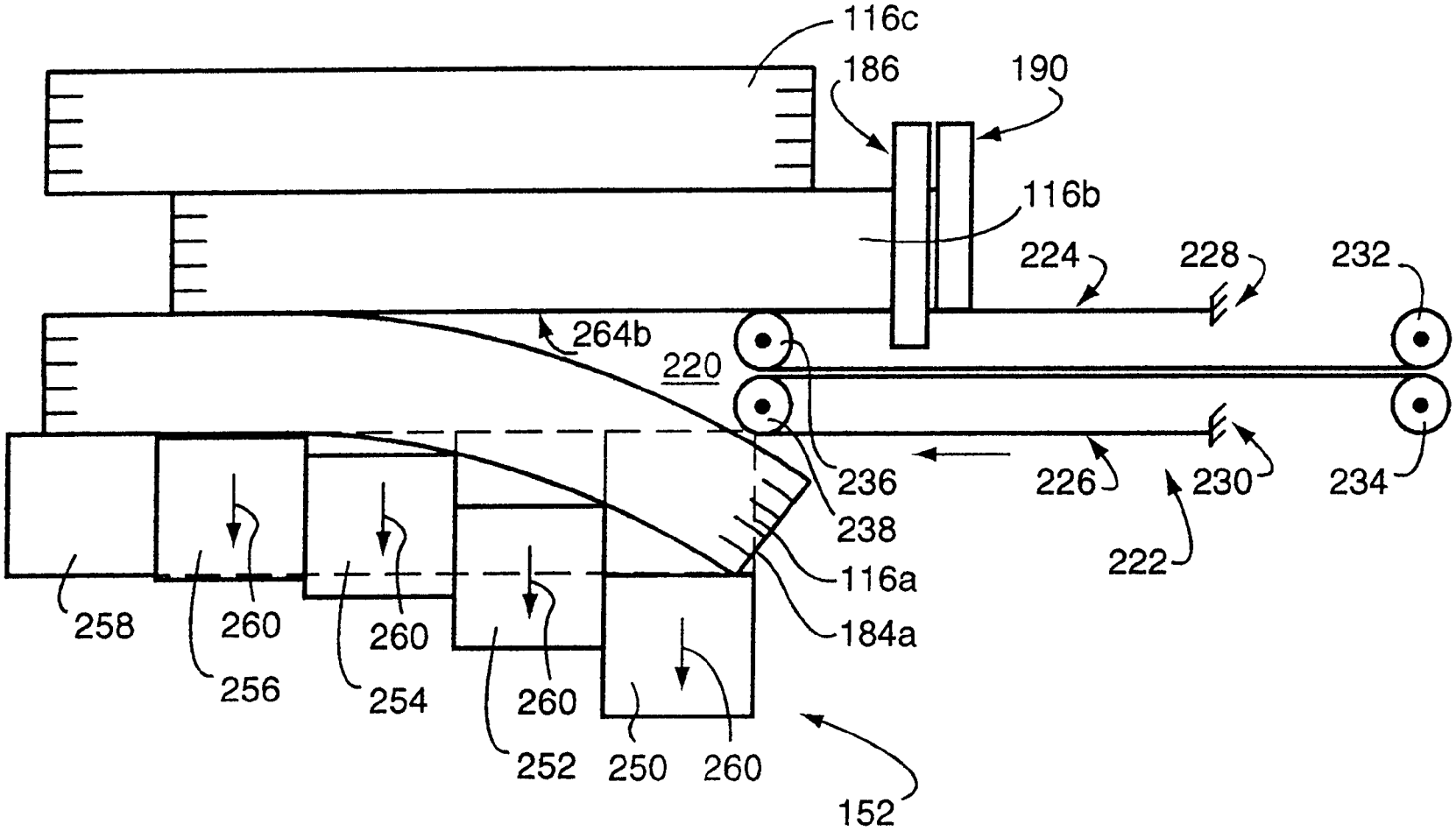
FIG. 11 is a schematic side view of the movement of the separating mechanism through the gap to fully separate the books.

With further reference to FIG. 11, as the separation assembly 222 enters the tunnel 220, the tunnel is enlarged by operation of the stack support 152 to enable the lower book 116*a* to move fully away (downwardly toward the level of the conveyor 273, see FIG. 5) from the center book 116*b*. The stack support 152 can be formed as a series of narrow segments 250, 252, 254,256 and 258 each having an elongated dimension transverse to the direction of travel of the separation assembly 222. The segments can move independently in a downward direction (arrows 260). As detailed, the segment 250 is located further downwardly than the adjacent segment 252. Likewise, segment 252 is moved further downward than segment 254 while segments 256 and 258 are essentially at their original location. As the separation assembly 222 moves across the stack, all the segments move successively into a fully downward state. Likewise, as the separation assembly 222 moves across the stack, it supports a larger proportion of the bottom face 264*b* of the center book 116*b*. Since the separation belts 224 and 226 do not slide relative to the bottom surface 264*b*, the bottom pages of the stack 116*b* are not disrupted. Note that fiber-lock and static adhesion assist in maintaining the sheets of the lower book in a justified orientation as the lower book is deposited on the conveyor 273 and, thence, moved onward to a bindery or other book-processing site.

Each of the supports 250, 252, 254, 256 and 258 moves downwardly (arrows 260) until the lower book 116*a* is completely separated from the center book 116*b*. At this time, the assembly 222 is fully paid out beneath the center book 116*b*. In a step not shown, the lower book 116*a* is transported to a further processing site, such as a bindery. The lower book 116*a* has been separated from adjacent book in a manner that prevents misalignment of individual sheets or pages.

Figure 12:
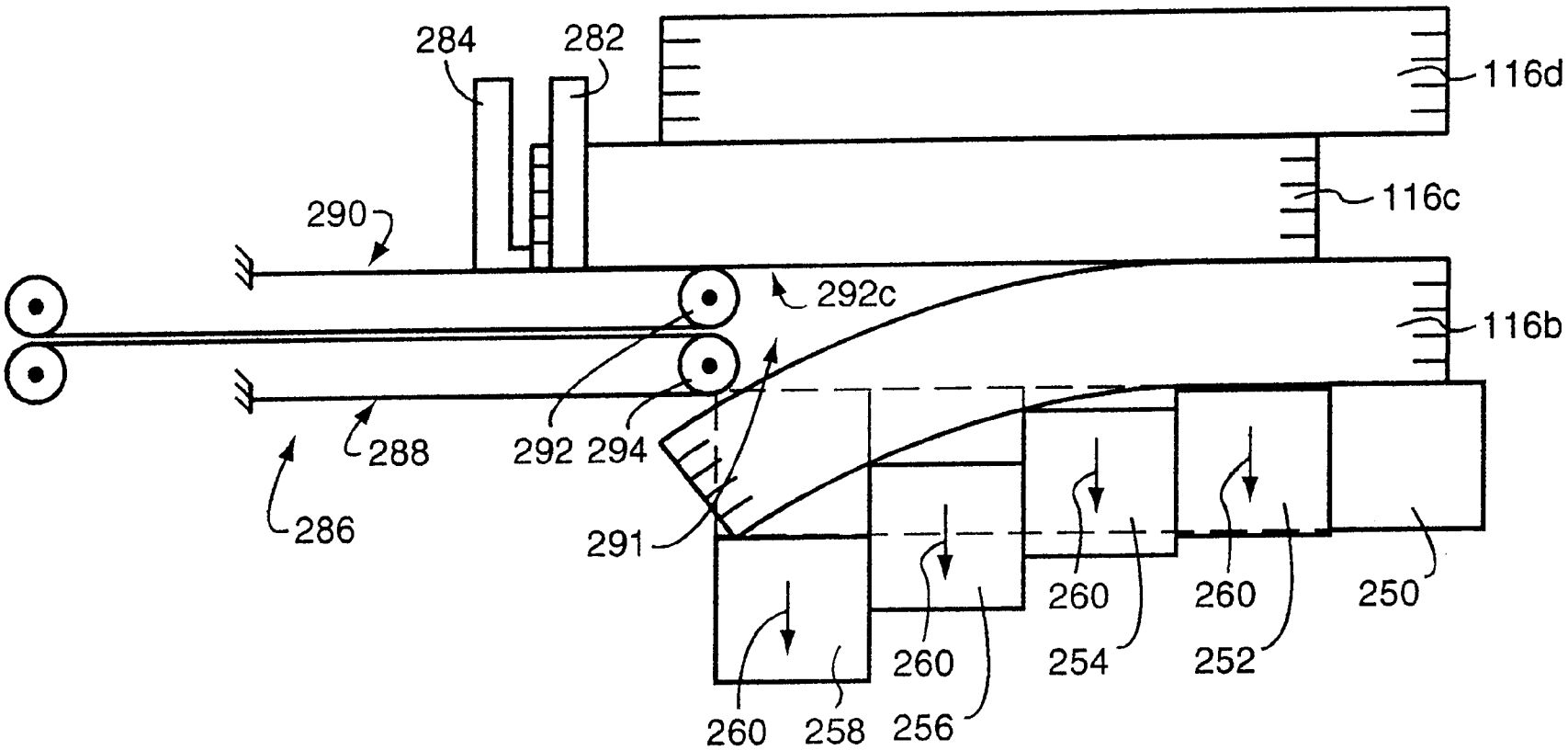
FIG. 12 is a schematic side view of the separation of a further book in the stack detailing an opposing separating projection.

As detailed in FIG. 12, the center book 116*b* is now separated from the upper book 116*c*. While the "center" book 116*b* is now the lowest book in the jog-offset stack, the terms "center" and "upper" shall be maintained for consistency. A further book 116*d* has now been deposited atop the upper book 116*c*, formed page-by-page by the upstream printer 106. The stack support segments 250, 252,254, 256 and 258 have already moved into an uppermost position (shown in phantom) and now move downwardly in an opposite direction to enable separation of the center book 116*b* from the upper book 116*c*. Likewise, the separation assembly 222 of FIG. 11 has moved out of interfering contact with the center book 116*b*, allowing the center book 116*b* to be deposited on the stack support segments. A similar, oppositely oriented set of retractable side supports 282 and lifting support 284 respectively retain the offset edge of the upper stack 116*c* and create a tunnel 291 in a manner described above. An oppositely directed separation assembly 286 now enters the tunnel 291 formed by the side and lifting supports 282 and 284. The separation assembly 286 defines a projection that includes a pair of oppositely facing separation belts 288 and 290 that are paid out concurrently by moving support rollers 292 and 294. As discussed above, the separation assembly 286 also moves into contact along the bottom face 292*c* of the upper book 116*c* without disrupting the bottom sheets. As also described above, with reference to the lower book 116*a*, the center book 116*b* is successively lowered out of contact with the upper book 116*c* as the support segments 250, 252, 254, 256 and 258 move successively downwardly (arrows 260). Concurrently, the separation assembly 286 moves across the bottom face 292*c* of the upper book 116*c* to support it. Again, while not shown the support segments 250,252, 254,256 and 258 move upwardly after the center book 116*b* has been transferred downstream and the support assembly 286 is withdrawn to deposit the books 116*c* and 116*d* atop the support segments and, thence, to the conveyor 273 (FIGS. 5 and 10) adjoining the segments. Note that the segments can be arranged so that they enable the downstream conveyor 273 to engage a portion of the deposited stack. In other words, a portion of the deposited stack lands on the conveyor, and it is, thereby, drawn away from the support segments. Alternatively, the segments can comprise individual elongated rollers, rather than the flat surfaces as shown, that move in synchronization to direct each deposited stack onto the downstream conveyor 273. The term "segment" should be taken to expressly include a driven roller that selectively moves upwardly and downwardly in the manner described herein.

Once another tunnel is formed between the upper and further books 116*c* and 116*d* respectively, the right-hand separation assembly 222 (FIG. 11) is then, again, inserted between the upper and further books 116*c* and 116*d*, respectively. The process continues until all books have been separated from each other and transferred downstream. Further books are continuously deposited on the stack and separated as needed downstream by the bindery. Note that books can be deposited on the job-offset stack a synchronously relative to the separation of books so long as a maximum stack size (defined by the limits of the particular printing mechanism) is not exceeded.

Figure 13:
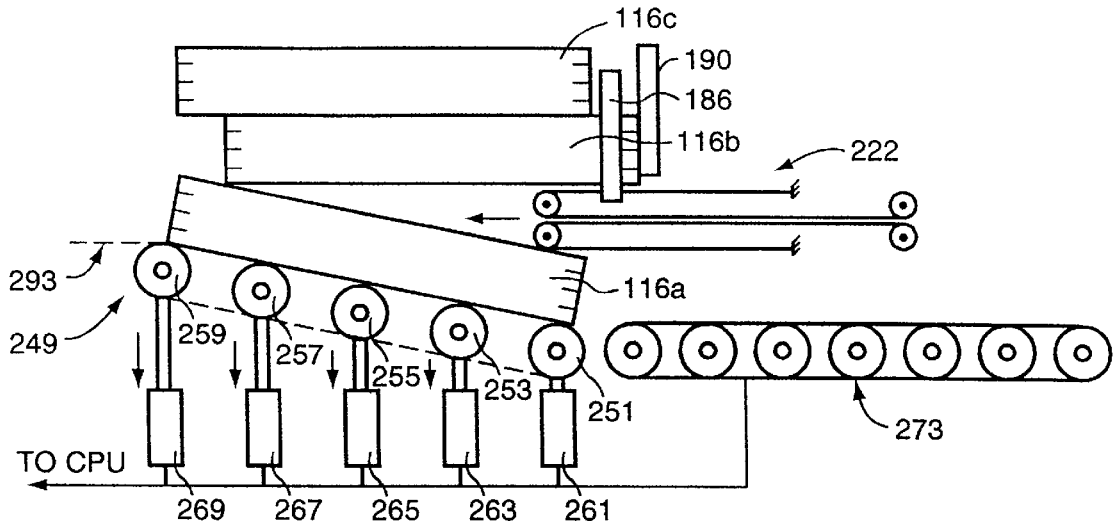
FIGS. 13–15 are schematic side views of the separation and conveying of a book according to an alternate embodiment of this invention detailing a support platform having a plurality of rollers thereon.
Figure 14:
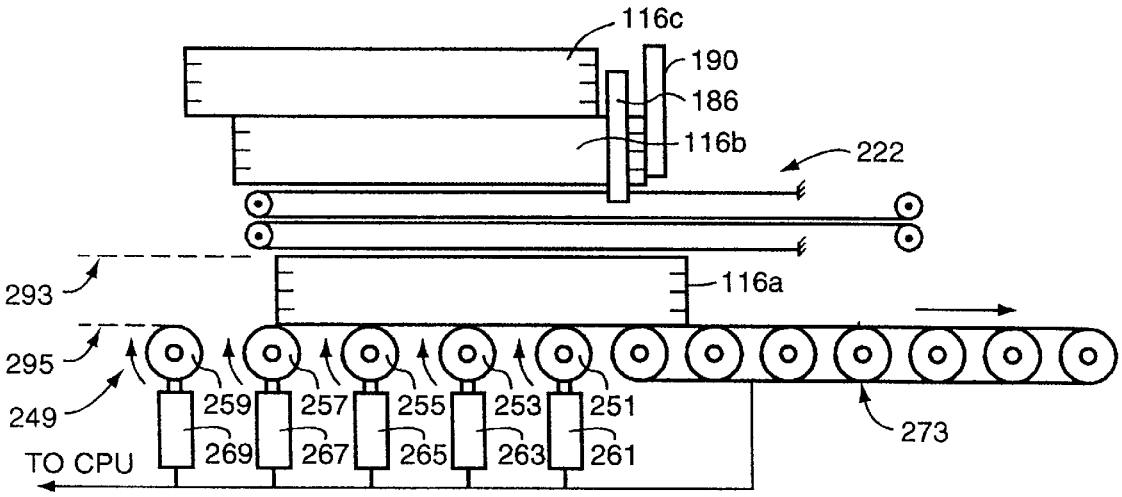
Figure 15:
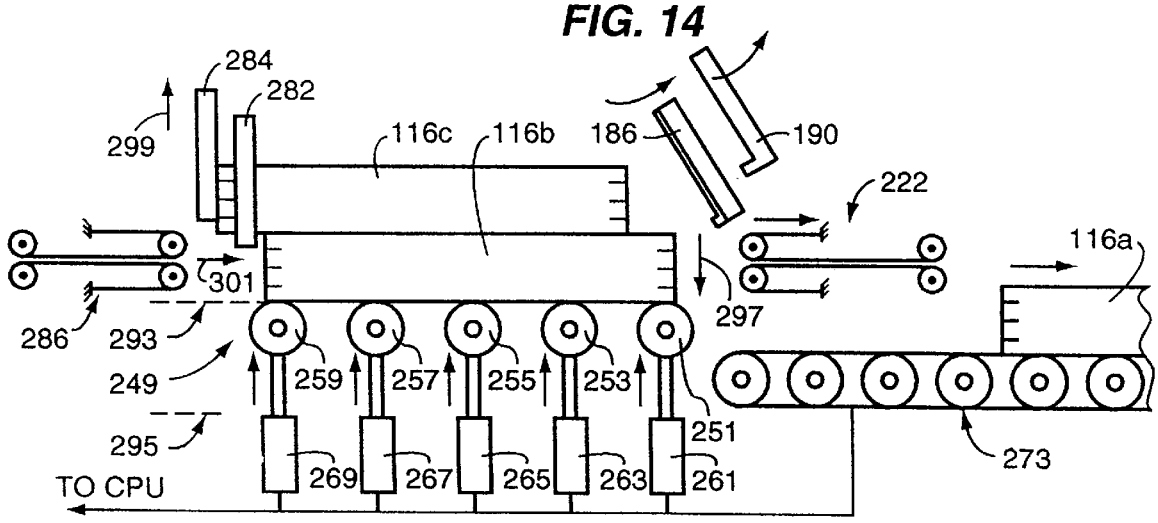

FIGS. 13, 14 and 15 detail a stack separation according to an alternate embodiment similar to that described above. Accordingly like components are provided with like reference numbers. This embodiment provides a support platform constructed from segments that comprise individual rollers 251, 253, 255, 257 and 259. The individual rollers are each movable upwardly and downwardly by respective linear actuators 261, 263, 265, 267 and 269. The actuators are each interconnected with the CPU so that they can be moved downwardly in succession to form a downward sloping "ramp" as shown in FIG. 13. To form a ramp, each actuator can move downwardly at a time delay to the next closest actuator, or all actuators can move downwardly at a different relative rate.

Each roller 251, 253, 255, 257 and 259 is powered by a drive motor (not shown). A single drive motor that connects all the rollers by belts or gearing can be used, or a plurality of individual drive motors can be provided to respective rollers. Likewise the actuators 251, 253, 255, 257 and 259 can be replaced with a unitary lifting mechanism having appropriate gearing and/or linkages to enable one or more motors to lower the rollers in the downward sloping ramp form shown in FIG. 13. It is expressly contemplated that the rollers and actuators form part of a moving platform that shifts position to stack jog-offset books in a manner described above. A support frame (not shown) can support the roller and actuator assembly and move the entire unit from side-to-side In brief summary, the embodiment of FIGS. 13–15 operates in the following manner.

The platform lowers the lowest book 116*a* while the separation assembly 222 moves between the lowest book and the center book 116*b*. The platform rollers are stationary at this time. The furthest roller 259 is just beginning its downward movement from a suspended elevation 293 (shown as a dashed line) at which the lowest book is supported to pass the separation assembly between the books. Note, in any of the embodiments described herein, the suspended elevation 293 can be varied to accommodate different thickness lower books so that the separation assembly 222 is properly aligned with the top of the lowest book. Alternatively, the elevation of the separation assembly can be varied based upon the thickness of the lowest book (with the suspended elevation being relatively constant) to properly align it with the top of the lowest book. Height sensors adjacent the platform 149 can be used to effect height adjustment of the platform 249, the separation assembly(ies) or both.

In FIG. 14, the separation assembly 222 has now moved fully beneath the center book 116*b* and the rollers of the platform 249 have moved fully downwardly into the conveying elevation 295 (shown as another dashed line). At this time the CPU has directed the rollers to begin rotating to drive the lowest book 116*a* onto the conveyor 273. The CPU has also directed the conveyor 273 to begin rotating to receive the book. The drive speed of the rollers can be sufficient to remove the book 116*a* from beneath the rollers before the next separation cycle begins.

The next separation cycle occurs in FIG. 15. The right-hand side supports 186 and lifting support 190 have retracted. The rollers 251, 253, 255, 257 and 259 have again moved upwardly so that all the rollers are now at the suspended elevation 295. The rollers are stationary, having ceased rotation, ready to receive the center book 116*b*. The right-hand separation assembly 222 has retracted to a remote position. Retraction occurs at some time after the upward movement of the rollers. The stack consisting of the center book 116*b* and the upper book 116*c* are, thereby, dropped (arrow 297) onto the rollers, now at the suspended elevation. Alternatively, the rollers can move upwardly beyond the suspended elevation to receive the center book 116*b* as the separation assembly 222 retracts. The rollers would then each lower to the suspended elevation for the separation step. The left-hand side supports 282 and lifting support 284 engage the upper book 116*c* and form (arrow 299) a tunnel into which the left-hand separation assembly 286 begins to enter (arrow 301). The roller 259 closest to the left-hand separation assembly 286 will begin downward movement to enable the left-hand separation assembly to enter. The downward movement of the roller 259 will be followed by the downward movement of rollers 257, 255, 253 and 251 in succession. The separated lowest book 116*a* has moved further downstream based upon movement of the conveyor.

Note that the number of rollers or other segments used for the platform according to the above-described embodiments can be varied depending upon the size, thickness and flexibility of books in the stack. Likewise the separate left and right-hand separation assemblies and side/lifting supports shown herein can be substituted for a single set of side/lifting supports and separation assembly according to an alternate embodiment. An appropriate carriage (not shown) can be used to move the supports and separation assembly to each side of the stack to engage alternating offset edges. Conveyors can be provided to each side of the separation location so that separated books can be transported away to different locations. In addition, it is contemplated that a belt assembly (shown in phantom as an option in FIG. 13) can surround the rollers 251, 253, 255, 257 and 259 to provide a substantially continuous moving support surface. By providing a relatively flexible belt, and by moving the rollers upwardly and downwardly in predetermined synchronization, a substantially continuous, ramped belt surface can be maintained beneath the lowest book.

Figure 16:
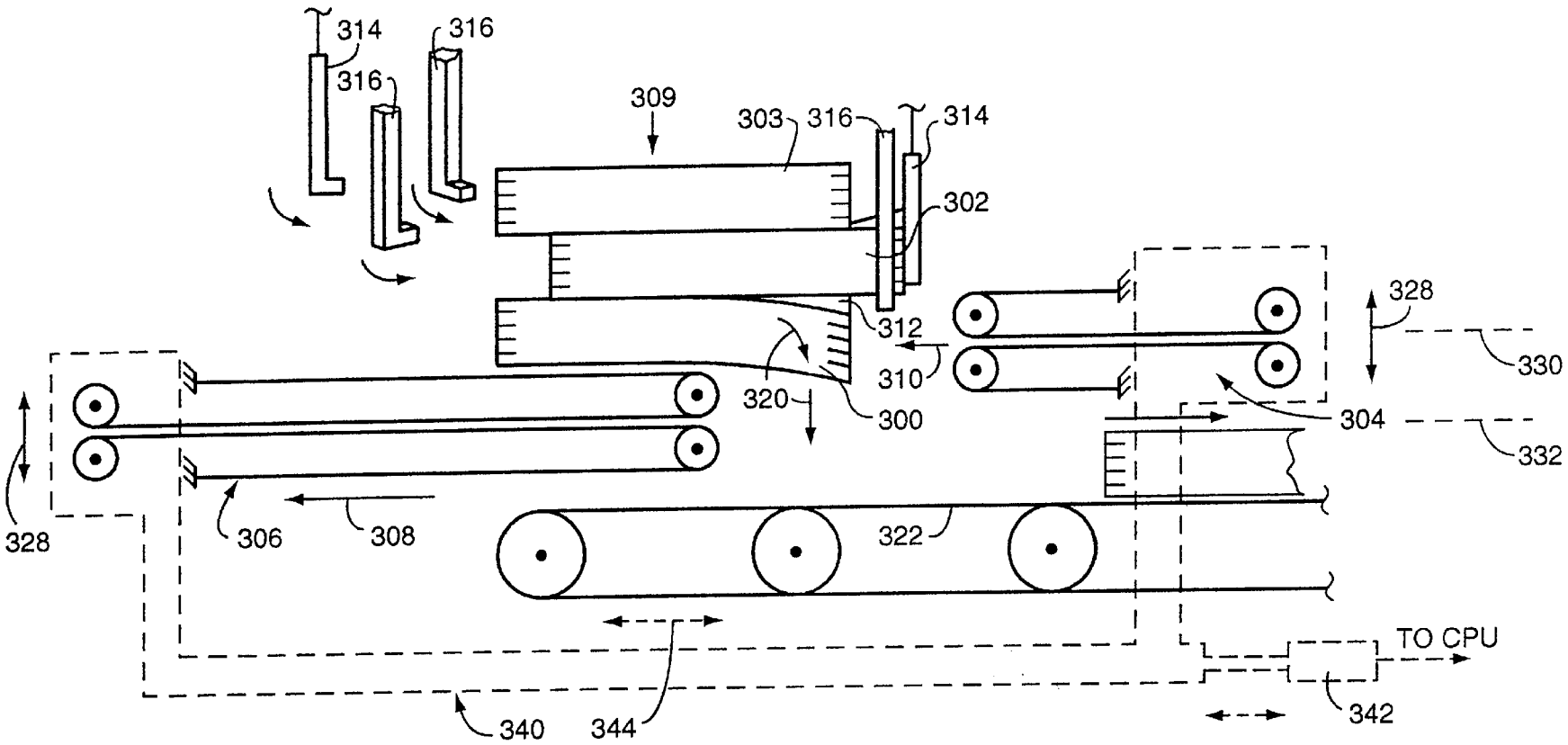
FIG. 16 is a schematic side view of an apparatus for sorting and separating books of sheets having an alternating separating projections that both support and separate offset books in a stack according to an alternate embodiment of the invention.

FIG. 16 illustrates a complete stack separation system according to an alternate embodiment in which the bottom book 300 is separated from the center book 302, and the center book is separated from the upper book 303 by respective right-hand and left-hand separation assemblies 304 and 306, according to this invention that also, alternately, act as supports for the next-highest book in the stack. The right-hand and left-hand separation assemblies 304 and 306, respectively, are adjacent opposing sides of the stack. The upstream conveying and printing functions are unchanged. The left-hand, opposing separation assembly 306 retracts (arrow 308) as the right-hand separation assembly 304 is driven (arrow 310) into the separation tunnel 312 formed between books 300 and 302 in the stack 309. The side and supports 314 and 316, respectively, operate in the manner described above to form a respective tunnel between adjacent books in the stack. The book 300 is separated by the right-hand separation assembly 304 so that it moves downwardly (arrow 320) onto the conveyor 322. The downward movement of the book is facilitated by the retraction (arrow 308) of the opposing, left-hand separation assembly 306 which acts similarly to the movement of successive support segments described above. When the left-hand separation assembly 306 has retracted completely, the lower book 300 is fully deposited onto the conveyor 322. Concurrently, the right-hand separation assembly 304 now fully supports the center book 302. The right-hand separation assembly 304 is moved downwardly and the now-remote second separation assembly 306 is moved upwardly, (double arrows 328) to, alternately, support the center book 302 and separate the center book 302 from the upper book 303. When each new book is supported by a respective, alternate separation assembly 304 or 306, the separation assembly is first lowered so that a respective set of lifting supports can be directed between the current bottom book and the current center book. The two separation assemblies 304 and 306, thus, alternate between the upper, suspended elevation (line 330) and the lower, separation elevation (dashed line 332) as each book is moved onto the conveyor 322. In this manner, a specialized support platform is not required. The elements for lifting and lowering each support assembly 304 and 306 can be conventional and can comprise numeric actuators, rack and pinion gear systems or a variety of other linear motion systems.

Since a moving support platform is not used according to this embodiment, the jog-offset between books in the stack can be created by mounting both separation assemblies on a moving frame (shown in phantom) having an actuator 344 (also shown in phantom) similar to that described above (or another form of side-to-side movement mechanism). The separation assemblies 304 and 306 are moved as a whole from side-to-side (phantom double arrow 344) as they support alternately support the stack, ensuring that the next book in the stack is formed with an appropriate offset relative to the adjacent book in the stack upon which it is formed.

The foregoing has been a detailed description of a preferred embodiment of the invention. Various modifications and additions can be made without departing from the spirit and scope of the invention. For example, a variety of mechanisms can be used to effect separation between stacks. Hence, while rollers that pay out flexible surfaces are used in this embodiment, lower friction fingers or tongues can also be used. The size of the jog-off stack can be larger or smaller than that described. Lifting supports having a variety of geometries can be implemented. Supports can enter from above the stacks or can enter from its sides. A variety of conveying systems can be used to form initial stacks and to move formed stacks to a downstream location, such as a bindery. In addition, jog-offset books can be formed from folded sheets in which fold lines are located along a single book edge to be bound in a subsequent step. The term "sheet" shall, thus, be taken broadly to include such a folded sheet as a whole and the term "book" shall be taken to include a justified stack of such "sheets." Finally, while a moving frame or platform is moved to offset sheets in one book from another, it is contemplated that the platform can be fixed, and that a portion of the conveyor leading to the platform can be moved from side-to-side to create the desired jog-offset. Alternately a kicker mechanism can be used to direct each sheet into a desired offset as it reaches the platform. Any acceptable technique for forming a jog-offset stack is expressly contemplated according to this invention. Accordingly, this description is meant to be taken only by way of example and not to otherwise limit the scope of the invention.

What is claimed is:

1. A method for separating books of sheets in a stack of books wherein each book in the stack is stacked with an edge offset relative to an adjacent book, thereby defining alternating offset edges in the stack, comprising the steps of:

stacking a lowest book and a book adjacent the lowest book in a stack;

engaging an overhanging edge of a book adjacent a lowest book in the stack with side supports and lifting a portion of the edge of the book between the side supports to an elevation higher than an elevation of the edge adjacent the side supports;

supporting a bottom face of the lowest book at a suspended elevation;

directing a separation assembly into a space defined between the side supports by the lifting step and concurrently removing support from at least a corner of the lowest book adjacent one of the side supports to further define the space, wherein the corner moves to a location below the suspended elevation; and successively removing support from the bottom face of the lowest book as the separation assembly moves into engagement with the book adjacent the lowest book to thereby deposit the lowest book at a remote elevation lower than the suspended elevation while the book adjacent the lowest book is concurrently taken out of contact with the lowest book to be supported by the separation assembly.

2. The method as set forth in claim 1 wherein the step of removing support comprises moving each of a plurality of support segments downwardly in succession to define a downward-sloping ramp that moves from the suspended elevation to the remote position as the separation assembly moves across a bottom face of the book adjacent the lowest book.

3. The method as set forth in claim 2 further comprising conveying the lowest book to a downstream location, remote from the support segments when the support segments are each at the remote elevation with the lowest book positioned thereon.

4. The method as set forth in claim 3 wherein the step of conveying includes providing segments that are driven rollers and rotating the rollers to remove the lowest book from the rollers.

5. The method as set forth in claim 1 wherein the step of directing the separation assembly includes applying a first belt having a fixed end and a movable end to the bottom face of the book adjacent the lowest book in an area adjacent the space.

6. The method as set forth in claim 5 wherein the step of directing the separation assembly further comprises applying a second belt facing opposite the first belt to a top surface of the lowest book in the area adjacent the space.

7. The method as set forth in claim 1 wherein the step of stacking includes, first, printing a first plurality of sheets in an order defining a first series of ordered printed pages and stacking the first plurality of sheets in a predetermined justification as the lowest book in a stack and, second, printing a second plurality of sheets in an order defining a second series of ordered printed pages and stacking the second plurality of sheets in a predetermined justification atop the lowest book in the stack as the book adjacent the lowest book, including stacking the second plurality of sheets with edges offset from adjacent edges of the first plurality of sheets to thereby produce the overhanging edge.

8. The method as set forth in claim 7 wherein the step of stacking the second plurality of sheets with edges offset from adjacent edges of the first plurality of sheets includes moving a support platform between at least two positions separated by a distance equal to a desired offset size of the overhanging edge between the step of stacking the first plurality of sheets and the second plurality of sheets.

9. A method for separating a plurality of jog-offset, stacked books of sheets in which each book has a justified edge offset from an adjacent justified edge, comprising the steps of:

engaging an overhanging offset edge of a book located atop a lowest book in a stack of jog-offset books and lifting a bottom portion of the offset edge above a suspended elevation to break adhesive contact with a top of the lowest book while supporting opposing corners of the offset edge at the suspended elevation;

removing support from a portion of the lowest book at an edge adjacent the offset edge thereby causing a downward droop in the portion away from the offset edge to thereby define a space between the droop and the offset edge; and directing a separation projection into the space as support is further removed from the lowest book to cause the lowest book to drop to a lower elevation as the book is maintained by the projection at the suspended elevation.

* * * * *